US010570665B2

(12) United States Patent
Maw et al.

(10) Patent No.: US 10,570,665 B2
(45) Date of Patent: Feb. 25, 2020

(54) DRILL BIT

(71) Applicant: ULTERRA DRILLING TECHNOLOGIES, L.P., Fort Worth, TX (US)

(72) Inventors: Jason Maw, Beaumont (CA); Benjamin Chrest, Holmen, WI (US); Ryan Matthews, Fort Worth, TX (US); Thomas Alan Damian, Denver, CO (US); Carl Aron Deen, Fort Worth, TX (US); Andrew David Murdock, Fort Worth, TX (US)

(73) Assignee: Ulterra Drilling Technologies L.P., Fort Worth, TX (US)

( * ) Notice: Subject to any disclaimer, the term of this patent is extended or adjusted under 35 U.S.C. 154(b) by 568 days.

(21) Appl. No.: 14/626,736

(22) Filed: Feb. 19, 2015

(65) Prior Publication Data

US 2015/0233186 A1 Aug. 20, 2015

Related U.S. Application Data

(60) Provisional application No. 61/942,492, filed on Feb. 20, 2014.

(51) Int. Cl.

| | |
|---|---|
| ***E21B 10/43*** | (2006.01) |
| ***E21B 10/55*** | (2006.01) |
| ***E21B 10/60*** | (2006.01) |
| ***E21B 10/54*** | (2006.01) |

(52) U.S. Cl.

CPC ..... *E21B 10/43* (2013.01); *E21B 10/55* (2013.01); *E21B 10/602* (2013.01); *E21B 2010/545* (2013.01)

(58) Field of Classification Search

CPC ..... E21B 10/43; E21B 10/55; E21B 10/545

See application file for complete search history.

(56) References Cited

U.S. PATENT DOCUMENTS

| | | | |
|---|---|---|---|
| 1,923,488 | A | 8/1933 | Howard et al. |
| 2,223,600 | A | 12/1940 | Carleton |
| 2,708,105 | A | 5/1955 | Williams, Jr. |
| 2,783,973 | A | 3/1957 | Hawthorne et al. |

(Continued)

FOREIGN PATENT DOCUMENTS

| | | |
|---|---|---|
| SU | 378618 | 4/1973 |
| SU | 791890 | 12/1980 |

OTHER PUBLICATIONS

International Preliminary Report on Patentability received in Patent Cooperation Treaty Application No. PCT/US2015/016684, dated Sep. 1, 2016, 7 pages.

(Continued)

*Primary Examiner* — David J Bagnell
*Assistant Examiner* — Manuel C Portocarrero
(74) *Attorney, Agent, or Firm* — Kilpatrick Townsend & Stockton LLP

(57) ABSTRACT

A rotating bit with cutters used in drilling operations to advance a borehole in the earth. The bit includes column cutters in the bit body in a recessed central area. The column cutters contact a column of borehole material that is formed during operation. The column cutters are oriented to fracture the column, producing larger cuttings or chips, and to exert a force on the column to limit lateral movement of the bit during operation.

28 Claims, 6 Drawing Sheets

(56) References Cited

U.S. PATENT DOCUMENTS

| | | | | |
|---|---|---|---|---|
| 3,174,564 | A | 3/1965 | Morlan | |
| 3,180,440 | A | 4/1965 | Bridwell | |
| 3,251,425 | A | 5/1966 | Bridwell et al. | |
| 5,103,922 | A | 4/1992 | Jones | |
| 5,549,171 | A | 8/1996 | Mensa-wilmot et al. | |
| 5,655,614 | A | 8/1997 | Azar | |
| 6,062,235 | A | 5/2000 | Renna | |
| 6,164,394 | A | 12/2000 | Mensa-wilmot et al. | |
| 6,296,069 | B1 * | 10/2001 | Lamine | E21B 10/46 175/348 |
| 7,703,557 | B2 | 4/2010 | Durairajan et al. | |
| 7,762,355 | B2 | 7/2010 | McClain et al. | |
| 8,418,785 | B2 | 4/2013 | Azar | |
| 8,439,136 | B2 | 5/2013 | Jones et al. | |
| 8,839,886 | B2 | 9/2014 | Jones et al. | |
| 9,366,090 | B2 | 6/2016 | Azar et al. | |
| 10,233,696 | B2 | 3/2019 | Casad | |
| 2009/0084606 | A1 | 4/2009 | Doster | |
| 2010/0193253 | A1 * | 8/2010 | Massey | E21B 10/60 175/393 |
| 2010/0252332 | A1 | 10/2010 | Jones et al. | |
| 2011/0108326 | A1 * | 5/2011 | Jones | E21B 10/43 175/57 |
| 2011/0266071 | A1 | 11/2011 | Lind | |
| 2012/0085583 | A1 | 4/2012 | Logan et al. | |
| 2015/0107902 | A1 | 4/2015 | Downton | |

OTHER PUBLICATIONS

"Ridge", Retrieved From https://www.thefreedictionary.com/ridge, 2018, 6 pages.

U.S. Appl. No. 14/742,339 , "Final Office Action", dated Jun. 18, 2018, 24 pages.

U.S. Appl. No. 14/742,339 , "Notice of Allowance", dated Nov. 7, 2018, 15 pages.

U.S. Appl. No. 15/427,642 , "Non-Final Office Action", dated Jan. 14, 2019, 10 pages.

Varhaug , "Bits", The Defining Series, www.slb.comd/defining, 2016, 2 pages.

International Application No. PCT/US2019/045525, "International Search Report and Written Opinion", dated Oct. 16, 2019, 10 pages.

* cited by examiner

DRILL BIT

TECHNICAL FIELD OF THE INVENTION

This invention is related in general to the field of drill bits. More particularly, the invention is related to a rotary drill bit with crushing cutters in the center or cone region of the bit to advance a borehole.

BACKGROUND OF THE INVENTION

In a typical drilling operation, a drill bit is rotated while being advanced into a rock formation. There are several types of drill bits, including roller cone bits, hammer bits and drag bits. There are many kinds of bits and cutters with different features and cutter configurations.

Drag bits typically include a body with a plurality of arms or blades extending from the body. The bit can be made of steel alloy, a tungsten matrix or other material. Drag bits typically have no moving parts and are cast or milled as a single-piece body with cutters brazed into the blades of the body. Each blade supports a plurality of discrete cutting elements that contact, shear and/or crush the rock formation in the wellbore as the bit rotates to advance the borehole. Cutters on the shoulder of drag bits effectively enlarge the borehole initiated by cutters on the nose and in the cone, or center, of the drill bit.

FIG. 1 is a schematic representation of a drilling operation 2. In conventional drilling operations a drill bit 10 is mounted on the end of a drill string 6 comprising drill pipe and drill collars. The drill string may be several miles long and the bit is rotated in the bore either by a motor proximate to the bit or by rotating the drill string or both simultaneously. A pump 8 circulates drilling fluid through the drill pipe and out of the drill bit flushing rock cuttings from the bit and transporting them back up the wellbore. The drill string comprises sections of pipe that are threaded together at their ends to create a pipe of sufficient length to reach the bottom of the wellbore 4.

Cutters mounted on blades of the drag bit can be made from any durable material, but are conventionally formed from a tungsten carbide backing piece, or substrate, with a front facing table comprised of a diamond material. The tungsten carbide substrates are formed of cemented tungsten carbide comprised of tungsten carbide particles dispersed in a cobalt binder matrix. The diamond table, which engages the rock formation, typically comprises polycrystalline diamond ("PCD") directly bonded to the tungsten carbide substrate, but could be any hard material. The PCD table provides improved wear resistance, as compared to the softer, tougher tungsten carbide substrate that supports the diamond during drilling.

Cutters shearing the rock in the borehole are typically received in recesses along the leading edges of the blades. The drill string and the bit rotate about a longitudinal axis and the cutters mounted on the blades sweep a radial path in the borehole, failing rock. Bit dynamics in operation can be complex with several overlapping modes of motion that in specific circumstances can damage portions of the bit.

Cutters designed to shear rock formations are principally loaded predominantly normal to the PCD face and are subject to damage when loaded in the opposite direction. Drag bits tend to whirl in the wellbore, increasing the diameter of the hole beyond the diameter of the bit. During whirl, the bit rotates in one direction but bit whirl can generate significant rotational motion in the opposite direction producing a complex movement of the bit. Cutters on the blades near the center of the bit, close to its longitudinal axis, move in a reverse direction to the rotation of the bit and can sustain damage as the diamond tables can be pulled away and separated from the substrate. Cutters distributed on the blades of the bit further from the center are not subject to this reverse rotation and damage.

If there were no cutters in the center of the bit, as the bit advances, a portion of the formation would extend from the bottom of the wellbore as a column. Once the column extended a sufficient distance to contact the bit body, it would bear on the surface of the bit, limiting forward progress and penetration of the bit. Many systems have been developed for drag bits and roller cone bits to break down this center column during drilling including downward extending tools that cycle to impact the column. These systems make the bit structure more complex with moving parts, making the manufacturing process more intricate and reducing reliability of the bit.

The center, or cone, portion of a bit tends to cut less efficiently than the peripheral portion of the bit, due to lower rotational surface speed, and less rock is removed in the center cone area. A roller cone drill bit with truncated cones spaced from each other and downward facing cutter inserts at the center of the bit is disclosed in U.S. Pat. No. 5,695,019 in an effort to improve penetration. A column created by the spaced cones removing surrounding material is fractured by the downward facing cutters.

SUMMARY OF THE INVENTION

The present invention generally pertains to drilling operations where a rotating bit with cutters advances a wellbore in the earth. The bit is attached to the end of a drill string and is rotated to fail the rock in the wellbore. Cutters on arms or blades of a bit contact the formation and fail the rock of the borehole by shearing or crushing.

In one aspect of the invention, a drill bit rotates about a bit longitudinal axis to advance a borehole and comprises a bit body with a pin connection at the upper end to allow attachment of the bit to the drill string, a recess at a leading end of the bit, and a profile which includes a recess in the center or cone of the bit. One or more cutters are mounted in the recessed cone portion of the bit profile, with the PCD or hard cutting surface pointing outward from the bit body. The cutting element or elements in the recess fracture the column of rock extending upward into the recess, formed as the borehole is advanced.

In another aspect of the invention, a drill bit has blades that converge close to the cone or central region of the bit profile that define a central recess. Three cutters are positioned at least partially within the recess with each cutter having a hard material, commonly PCD, contact face extending from the face and a cutter longitudinal axis facing generally parallel to the bit longitudinal axis.

In another aspect of the invention a drill bit includes cutters mounted in abase of the recess for advancing a borehole. Each cutter faces generally in the direction of the advancing borehole and inward with a positive back rake in the range of 30 and 70 degrees and a side rake in the range of 45 and 135 degrees in a negative direction in relation to a surface perpendicular to the longitudinal axis.

In another aspect of the invention, a drill bit comprises a bit body with blades, a face in a recess facing in the direction of advancement of the borehole and a longitudinal axis. First cutters mounted in the recess face generally in the direction of advancement of the borehole, and second cutters mounted on the blades facing generally in the direction of bit rotation about the longitudinal axis.

In another aspect of the invention, a drill bit to be fixed to a drill string at a mounting end of the bit comprises a recessed face at a leading end of the bit (in the cone of the bit) and a conduit from the face to a side of the bit body. Cutters with a base end are mounted in the recess of the bit body. The contact ends of these cutters extend from the face proximate the bit longitudinal axis to fracture a column portion of the rock extending toward the recess surface as the borehole is advanced. The fractured portions of the column pass through the conduit and up the borehole annulus.

Other aspects, advantages, and features of the invention will be described in more detail below and will be recognizable from the following detailed description of example structures in accordance with this disclosure.

DETAILED DESCRIPTION OF THE INVENTION

Figure 1:
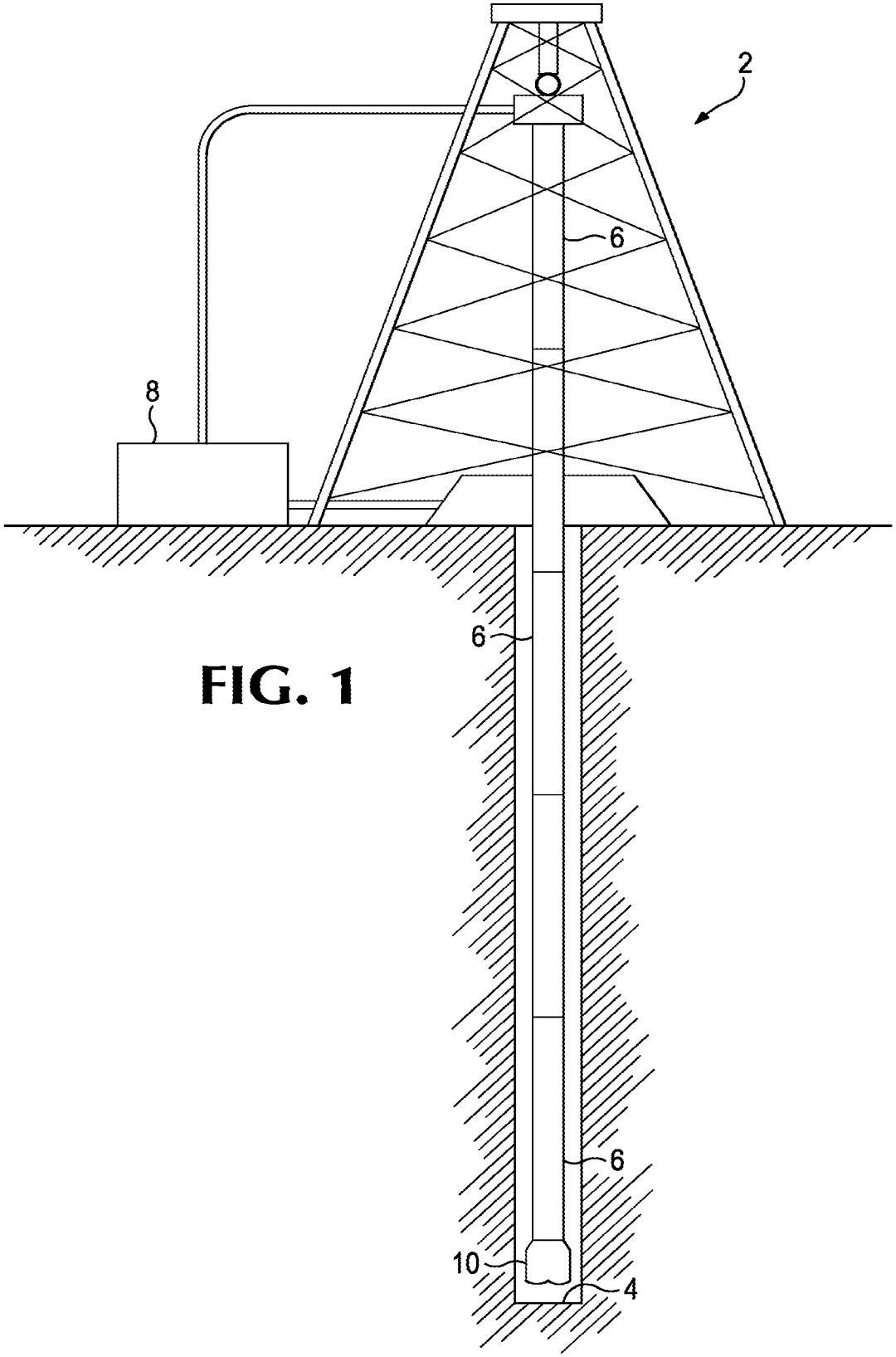
FIG. 1 is a schematic depiction of a drilling system according to an exemplary embodiment of the present invention.

Bits used in downhole boring operations such as for gas and oil exploration operate at extreme conditions of heat and pressure often miles underground. The rate of penetration of the bit in creating the wellbore is critical to a cost effective drilling operation. The rate of penetration depends on several factors including the density of the rock the wellbore passes through, the configuration of the bit and the weight on bit (WOB) among others.

Drag bits include most often, PDC cutters mounted on arms or blades of the bit that engage the surfaces of the wellbore to fail the rock in the wellbore. Each cutter is retained in a recess of the blade and secured by brazing, welding or other method. The cutters are distributed along the blades and each cutter is oriented with back rake and side rake to optimally engage the wellbore. Drilling fluid is pumped down the drill string through outlets, or nozzles, in the bit to flush the rock cuttings away from the bit and up the wellbore annulus.

The bit is advanced into the hole by the weight of the drill string and bottom hole assembly bearing on the bit. The WOB may be increased by adding collars to the drill string. The WOB can be decreased by pulling the top of the drill string at the surface. The cutters in the cone, nose and lower shoulder regions of the profile at the bit leading end have the greatest load pressing them against the bottom of the wellbore and generally engage the wellbore simultaneously. The cutters on the upper shoulder of the bit widen the borehole created by the cutters on the bit face.

The drag bit tends to have some lateral movement as it advances, cutting a larger diameter hole than the size of the bit. The bit then tends to whirl in the oversize wellbore causing the cutters in the center, or cone, of the bit to move in the opposite direction to the bit rotation. Whirling results in the bit's longitudinal axis moving in a circular path in the opposite direction to the simultaneous bit rotation around the longitudinal axis LA. Depending on the frequency of whirling and the radius of the circle of rotation of the bit axis, a number of the cutters inside the whirl radius will rotate backwards at a rotational speed proportional to the whirl frequency. The interface between the table of the cutter and the substrate of the cutter secured to the bit is weak in tension and the diamond table is subject to separation from the substrate under tension. Even momentary or transitory reverse rotation of the cutter can cause serious damage to the cutters reducing effectiveness of the bit.

Bits can be designed without cutters in the center of the bit face to limit exposure of the cutters to reverse motion during operation that would damage the cutters. This void in the center portion of the bit close to the axis of rotation does not therefore cut rock. As the bit rotates during operations the cutters sweep a path to fail the rock in front of them. A column of rock forms in the center area free of cutters. Once the column of rock extends far enough so as to contact the body of the bit in cutter free area, the rate of progress of the bit is significantly reduced.

Bits, cutters, other components and features are generally represented in FIGS. 2 through 7. Drill bits 10 generally include a body 12 and a threaded pin 14 at a mounting end 12A of the bit that connects to the end of a drill pipe 6. Blades 16 extend outward from the body 12 and support cutters 20 (referred to as shoulder cutters) extending around the bit profile to a leading end 12B of the bit opposite the mounting end. Blades 16 define channels or waterways 18 between the blades. Fluid is pumped down the drill pipe and out through openings, or nozzles, on the face of the bit to flush rock cuttings in the wellbore through the channels, or waterways, away from the bit and up to the surface. While drag bits are illustrated in the figures, the invention is not limited to drag bits. Advantages of the invention can be realized in roller cone bits or other bit configurations as well.

Center of bit rotation 22 coincides with the bit longitudinal axis LA and the center of the recess 24 about the longitudinal axis. Recess 24 may be defined by the ends 16A of blades 16. The area within recess 24 at leading end 12B is subject to reverse rotation from whirl of the bit that can damage the borehole cutters. Shoulder cutters 20 are positioned on blades generally outside recess 24 and face generally in the direction of rotation of the bit. Cutters 28 (referred to as column cutters) are mounted to the bit body 12 at a face 24A of recess 24. Column cutters 28 facing generally downward contact the top of column of rock 4A that is formed in recess 24. Column cutters can use the same construction as shoulder cutters. Alternatively, column cutters can use a different construction, different dimensions and/or different materials than shoulder cutters where the construction and materials perform a similar function.

With a downward and inward orientation, the column cutters apply an optimized force to the column as the bit rotates and progresses downhole through the rock to effectively fracture the rock of the column. Fracturing of the rock results in larger broken pieces of the column than the fine material produced by borehole cutters at the face of the borehole. Column 4A has a different fracture strength than the bulk material the bit advances through as it is unconfined due to the lack of any surrounding, uncut rock. The borehole walls tend to fail due to small fractures that result from the angle of attack of the shoulder cutter 20 and surrounding support for the rock. Column 4A tends instead to fracture in larger chips or chunks when impacted by the column cutters 28. Column 4A does not have the support of the surrounding material and the walls of the column form a large area without support that is relatively easy to fracture.

Figure 4:
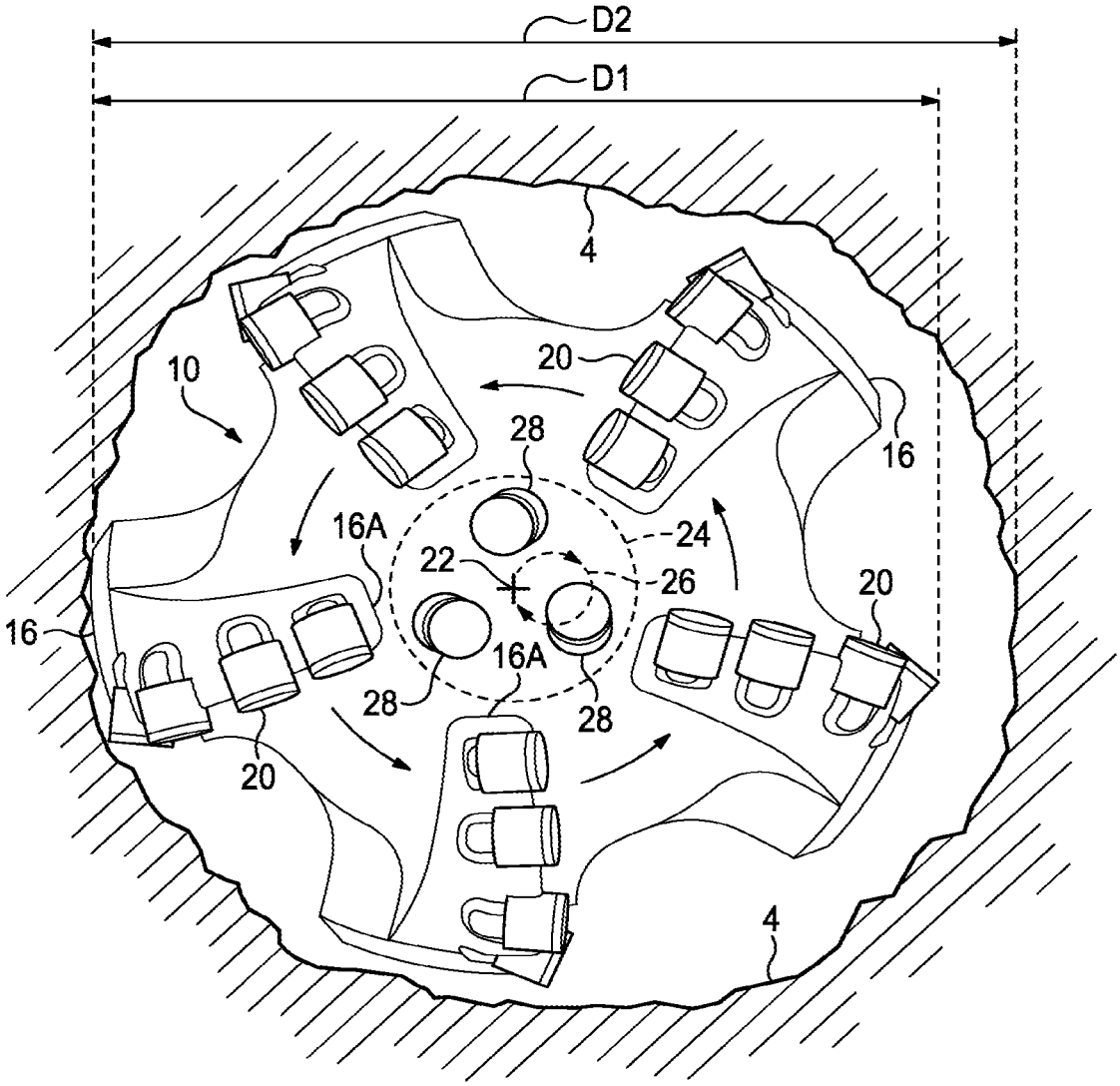
FIG. 4 is a front view of an inventive drill bit in a wellbore showing bit rotation and whirl of the bit.

FIG. 4 is an end view of a bit 10 in a wellbore 4 that is of greater diameter D2 than the diameter of the bit D1. The bit includes an axis of rotation 22 and the bit is shown rotating counter clockwise. During rotation of the bit the shoulder cutters of the bit contact the bore wall. Since the wellbore is larger than the bit one side of the shoulder area of the bit contacts the borehole wall while generally all the cutters on the front face or nose area of the bit contact the wellbore. The shoulder cutters on the one side on contacting the wellbore generate a tangential force on the bit. The bit then tends to whirl so the longitudinal axis and center of bit rotation 22 rotates in a clockwise direction generally following the whirl radius arc 26 centered in the wellbore as the point of contact of the cutters on the side of the bit progresses about the side of the wellbore. Circle 26 is defined separately from recess 24 though they generally overlap.

The size of the wellbore and whirl of the bit in the wellbore depend on a number of factors including the bit design, the density of the rock in the wellbore, the rotation speed and rate of penetration of the bit. The forces that initiate whirling of the bit are opposed by the friction of the shoulder cutters and by the development of column 4A as well as other factors.

Figure 3:
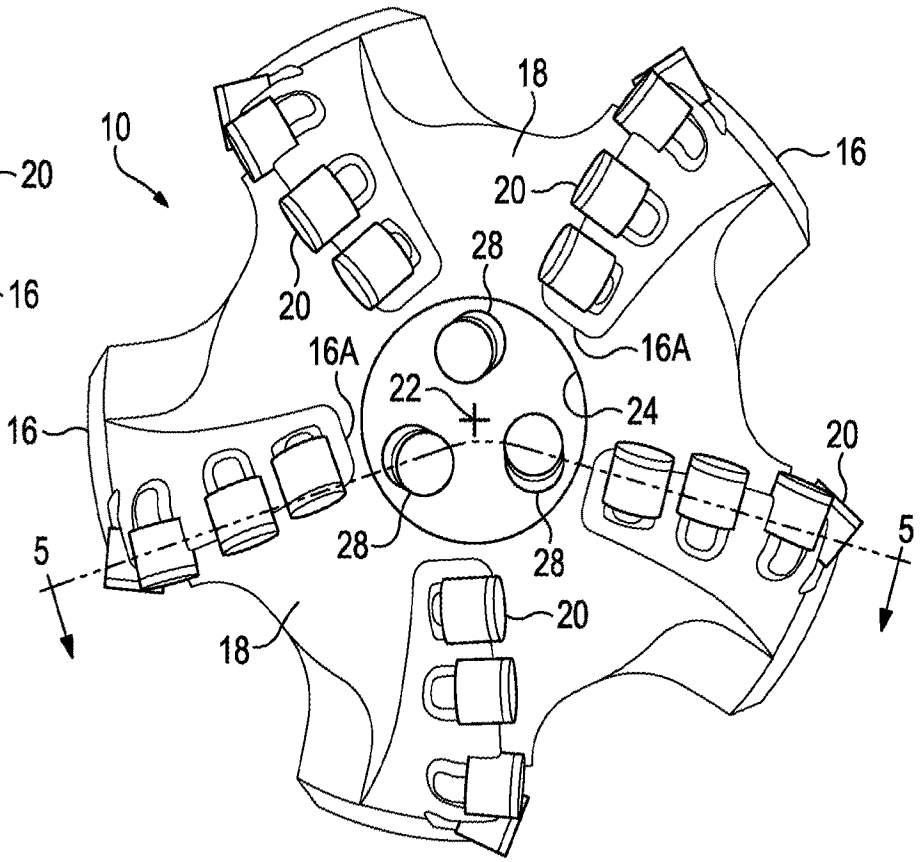
FIG. 3 is a front view of the inventive bit of FIG. 2.
Figure 2:
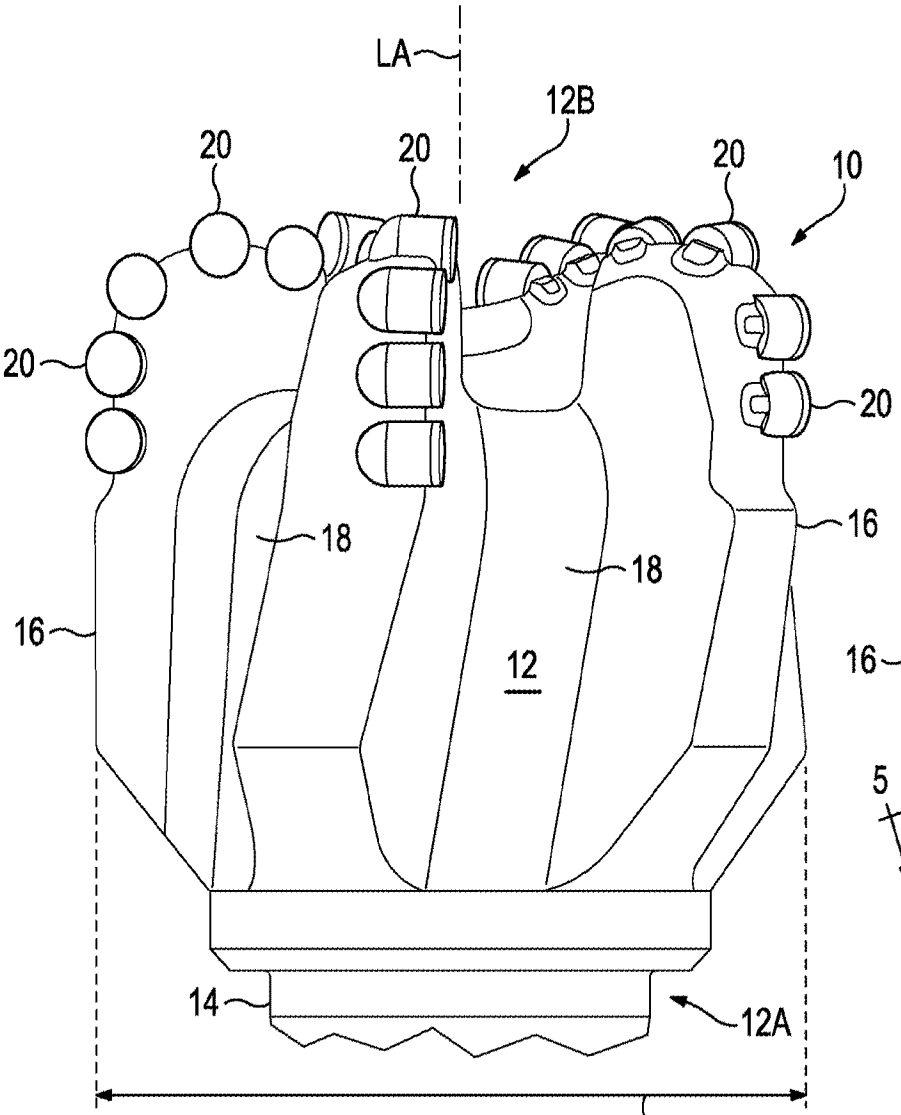
FIG. 2 is a side elevation view of an inventive bit with cutters for a drilling system.
Figure 5:
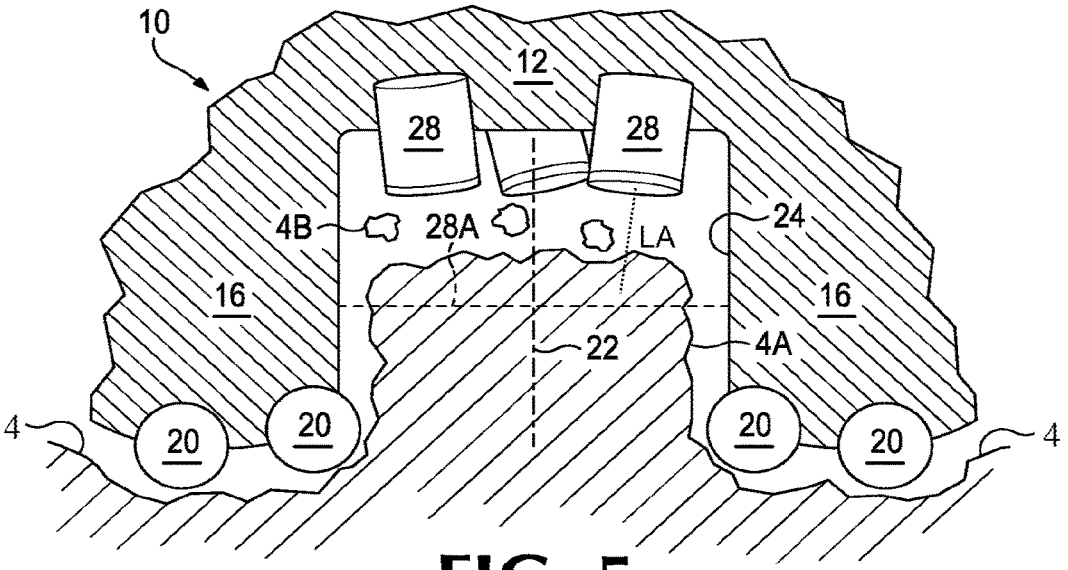
FIG. 5 is a partial cross section view along line 5-5 of FIG. 3 showing internal construction of the drill bit and the recess.

FIG. 5 is a cross section view of a section of bit 10 as indicated in FIG. 3. Bit 10 is shown engaging the bottom of wellbore 4 with shoulder cutters 20 mounted on blades 16 failing the rock of the wellbore. The bit includes recess 24 with its axis on the bit center of rotation 22 defined at least in part by the ends of blades 16A. Column 4A extends into recess 24 as the borehole advances. Column cutters 28 are positioned in the recess 24 on a face 24A of body 12 of bit 10 and column cutters 28 face generally downward to engage column 4A, failing the rock of the column in discrete chunks 4B as the bit rotates. Column cutters 28 are shown configured with a steep back rake and moderate side rake to engage the column and limit damage to the cutter's polycrystalline diamond, or alternate hard material table. In a preferred embodiment front face 24A along with recess 24 is bounded by a circle about the longitudinal axis with a radius the distance from the longitudinal axis to the edge of the nearest borehole cutter.

Figure 5A:
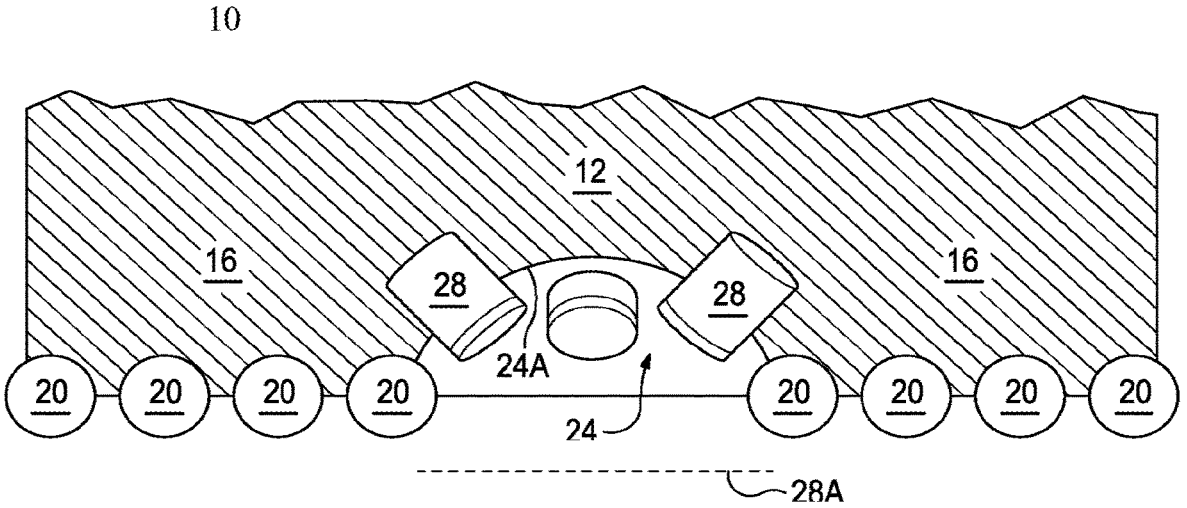
FIG. 5A is a cross section view similar to FIG. 5 showing internal construction of the drill bit and a domed recess.

Recess 24 can be any shape. FIG. 5A is a cross section view of bit 10 similar to FIG. 5. Bit 10 again includes bit body 12 and shoulder cutters 20 on blades 16. Recess face 24A is shown as curved and recess 24 is continuously curved defining a dome with column cutters 28 extending downward and inward with a similar orientation as shown in FIG. 5. Recess 24 can form a cone, a pyramid or any other shape that does not interfere with operation and orientation of the column cutters.

The end of the blade typically terminates with one or more shoulder cutters so the blade material is not subject to excessive abrasion or erosion. For a roller cone bit, the recess radius can be defined by the distance, measured radially, from the longitudinal axis to the closest tooth or insert mounted on a cone. Alternatively, the recess 24 can be an irregular shape defined by blades that terminate or end at different distances from the longitudinal axis.

A single column cutter can be used and configured to eject discrete rock chips 4B of column 4A in one direction from the front of the bit. Typically the single column cutter is positioned to sweep the rock within the recess and the flow of drilling fluid flushes the debris through the preferred channel. A single downward facing column cutter tends to form a bearing face which can detrimentally generate off center rotation or whirl of the cutter. In a preferred configuration three cutters oriented inward and downward to limit the initiation of bit whirl and efficiently fracture column 4A. With three column cutters, when the bit deflects laterally as may happen during whirling, a column cutter on the opposite side engages column 4A and generates a correcting force to re-center the bit. The use of more cutters in the recess, specifically located, could resist any lateral motion even more effectively. The arrangement of two column cutters could also be used.

Multiple downward facing column cutters are compatible with steering of the bit for directional drilling. As the bit is oriented or pointed to turn the bit, the column cutters on the side away from the turn direction contact the column 4A and the column cutters on the side towards the turn direction are offset from the column. This increases the force applied to one side of the column during steering fracturing one side of the column. The intact side of the column continues to extend into the recess until the column cutters on the opposite side again contact the column.

Figure 6:
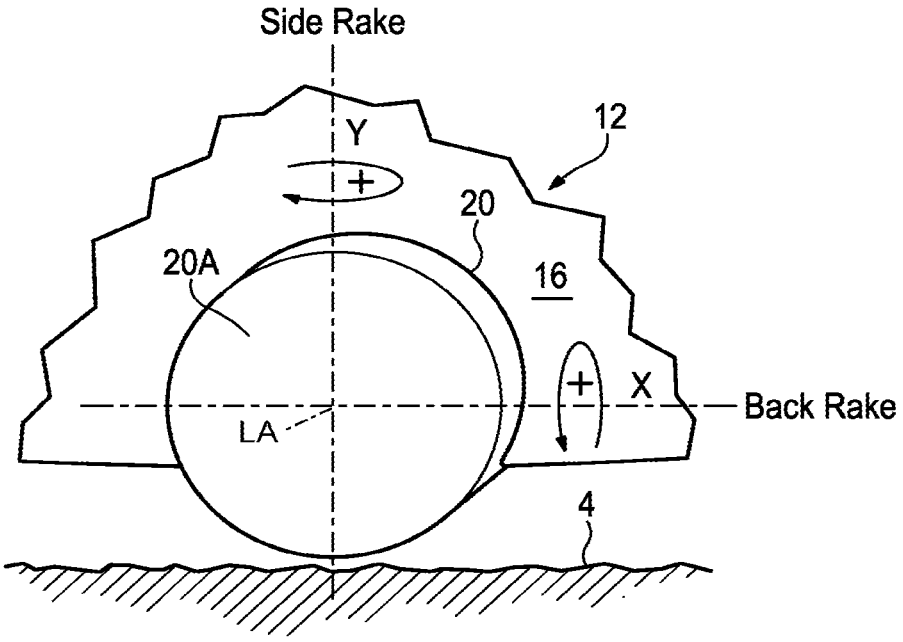
FIG. 6 is a front view of a cutter illustrating side and back rake angles.

FIG. 6 is a front view of a cutter 20 with cutter longitudinal axis LA and table 20A on the front face engaging the surface of a wellbore 4. Back rake and side rake for the cutter are typically referenced in relation to axes through the center of the cutter. An axis X passes through the center of the cutter parallel to the rock. A Y axis is perpendicular to the X axis and the rock face. Positive back rake rotates the orientation of the cutter about the X axis and moves the back end, or substrate, of the cutter into the bit body or blade surface. The front face of the cutter leans away from the rock such that the cutting edge of the cutter is generally behind the rest of the cutter when the bit is rotated around its axis. Positive side rake rotates the orientation of the cutter about the vertical axis Y to skew the cutter front face in relation to the direction of travel of the cutter. In FIG. 6 the cutter is shown at approximately a positive ten degree back rake angle and a positive ten degree side rake angle.

The reference face for column cutters 28 is an upward face 28A at the top of rock column 4A and forward of the face 24A. In most operations column cutters 28 can have a back rake in an inclusive range of 30 to 70 degrees in a positive direction and may have a side rake in an inclusive range of 45 to 135 degrees in a negative direction. Column cutters 28 preferably have a back rake in an inclusive range of 35 to 55 degrees in a positive direction and may have a side rake in an inclusive range of 70 to 90 degrees in a negative direction. Column cutters 28 more preferably have a back rake in an inclusive range of 40 to 50 degrees in a positive direction and more preferably have a side rake in an inclusive range of 75 to 85 degrees in a negative direction. Never the less, other back rake and side rake angles outside the noted ranges could be used depending on the use of the bit. In FIG. 5, the column cutters are shown at a back rake of about 70 degrees and a side rake of about negative 50 degrees.

The more preferred rake angles generally orient the cutter face downward in the direction of advancement of the borehole and the side rake skews the cutter inward toward the axis of bit rotation. This orientation of the column cutters applies an optimized downward force to fracture and fail the rock of the column in discrete chips that are flushed to the surface for analysis together with a radial or lateral force that centers the bit and resists radial displacement or whirl of the bit. The offset of the column cutter axes to face inward provides the lateral centering force urging the bit to continue to rotate about its center axis in a stable fashion as more lateral force is required to push the bit off its path. This optimized orientation protects the cutters from damage in case of reverse rotation, or bit whirl, by limiting impact forces on the table of the column cutter that can fail the polycrystalline diamond or separate the table from the substrate. The orientation of the column cutters 28 are distinct from the orientation of the borehole cutters 20 and reflect the different functions for the cutters and different stresses they are subject to.

The shoulder cutters oriented in the direction of rotation on the blade pulverize the rock to a fine consistency as the bit drills. The rock cuttings are flushed to the surface during operation by the drilling fluid circulated through the drill string and out of the bit's nozzles. Monitoring performance of the drilling operation includes analyzing the materials brought to the surface to determine the constituents and physical properties of the failed rock. The fine consistency of the cuttings created by the borehole cutters limits the kinds of geological analysis that can be performed at the surface. The rock column can be failed by crushing or fracturing in order to produce larger discrete chips, chunks or micro cores. These discrete chips then pass with the drilling fluid into the annulus of the borehole to the surface. Intact discrete chips of rock are analyzed to determine the strength of the rock and other properties of the rock.

Figure 7:
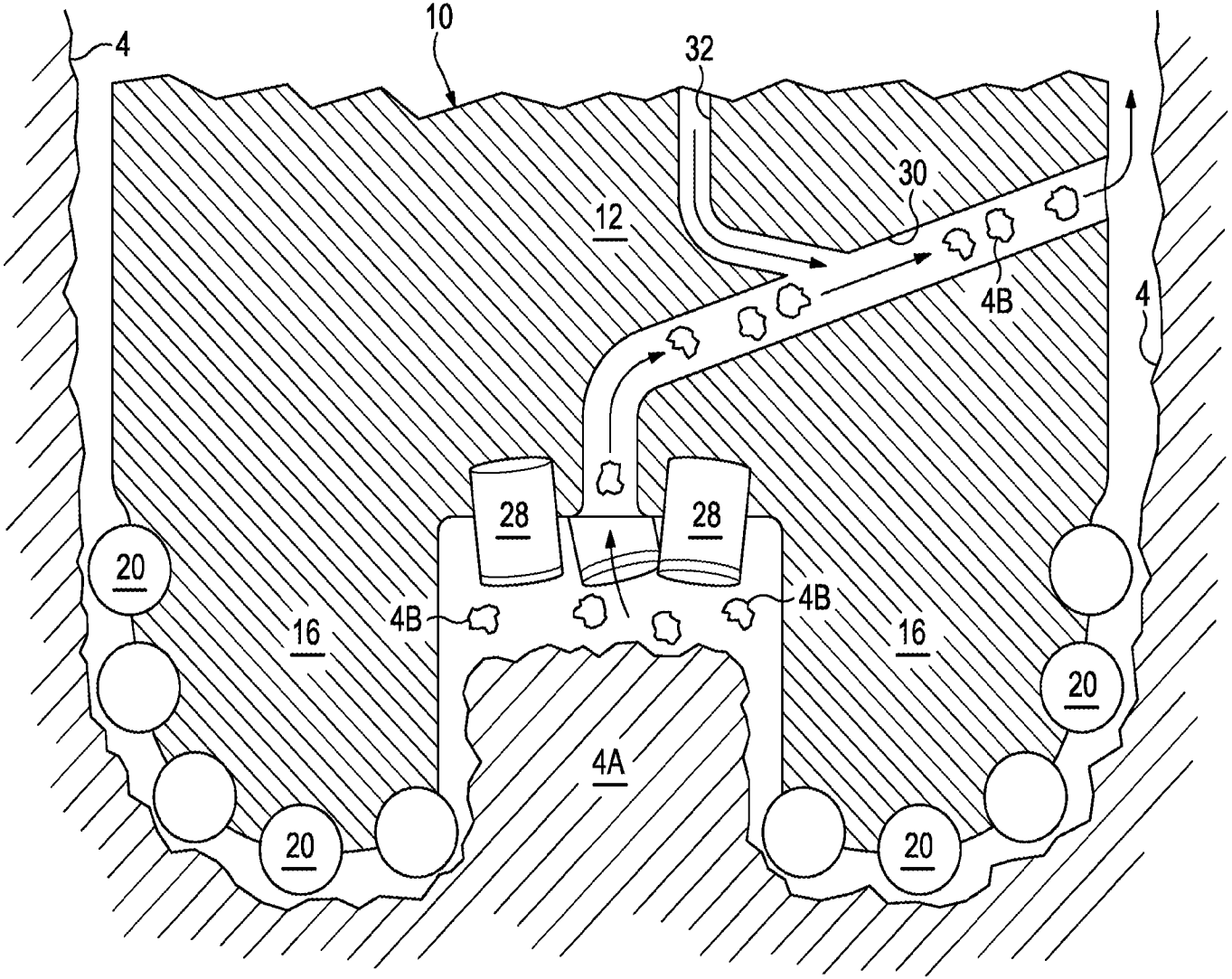
FIG. 7 is a cross section view similar to FIG. 5 showing conduits through the bit for flushing away crushed material.

FIG. 7 is a cross section view of an alternative embodiment of bit 10 similar to FIG. 4 engaging the bottom face of wellbore 4 with advancing column 4A. In this embodiment body 12 of bit 10 includes a conduit or passage 30 through bit 10 opening at front face 24A proximate to column cutters 28 with the conduit opening at the other end into the junkslot of bit 10. Preferably, the conduit increases in diameter extending from the recess of the bit to the junkslot of the bit so that the rock portions or micro cores 4B that enter the conduit are less likely to be wedged in the conduit. Discrete rock portions 4B of column 4A separated by column cutters 28 pass into conduit 30 and out the side of bit 10 to be transported to the surface in the circulating drilling fluid.

Typically in bits without conduits the rock portions are flushed in the waterways between the blades of the bit where they risk reduction in size by the borehole cutters on the blades. In passing through the conduit 30 rock portions 4B bypass borehole cutters 20 and avoid further reduction allowing larger chips to pass to the surface for analysis. A supply channel 32 is shown intersecting with conduit 30. Fluid channel 32 injects drilling fluid into conduit 30 to generate a positive flow and flush rock portions 4B through the conduit. Other channel and conduit configurations are possible. The fluid channel 32 in some embodiments may be omitted altogether.

It should be appreciated that although selected embodiments of the representative column cutters are disclosed herein, numerous variations of these embodiments may be envisioned by one of ordinary skill that do not deviate from the scope of the present disclosure. This presently disclosed invention lends itself to use for steel and tungsten carbide matrix bits as well as a variety of styles and materials of cutters.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

The invention claimed is:

1. A drill bit that rotates about a bit longitudinal axis to advance a borehole comprising:

a bit body with a mounting fixture at a mounting end, a recess at a leading end of the bit, a face within the recess, and blades that partially define the recess;

one or more column cutters, each including a base end mounted in the face within the recess, and a contact end, and each having a cutter longitudinal axis generally parallel to the bit longitudinal axis to fracture by crushing force a column of rock extending toward the face in the recess that is formed as the borehole is advanced;

shoulder cutters mounted on the blades to fracture rock by shearing force and to form the column of rock; and wherein each column cutter faces generally forward and inward with a positive back rake in an inclusive range of 30 to 70 degrees and a negative side rake in an inclusive range of 45 and 135 degrees.

2. The drill bit of claim 1 where at least a portion of each of the column cutters is within the recess.

3. The drill bit of claim 1 where the shoulder cutters face in the direction of rotation of the bit about the longitudinal axis.

4. The drill bit of claim 1 where the drill bit is a roller cone drill bit.

5. The drill bit of claim 1, wherein the recess defines an area subject to reverse rotation and a downward and inward orientation of the column cutter limits damage to the column cutter by reverse rotation.

6. A drill bit with a threaded pin at a mounting end for connecting to a drill string, a leading end spaced from the mounting end and a bit longitudinal axis comprising:

a bit body with blades extending from the body and generally converging close to a central cone region, the blades having ends that define at least in part a recess in the bit body, the recess defining a recess face and recess walls;

at least three column cutters mounted in the recess face at least partially within the recess, each of the column cutters with a cutter longitudinal axis and a contact face extending from the bit face to fracture by crushing force a column of rock extending toward the recess face as the borehole is advanced, the cutter longitudinal axis generally parallel to the bit longitudinal axis;

wherein the column cutters are configured to eject fractured portions in a direction from the front of the bit; and wherein each column cutter faces generally downhole with a positive back rake angle in an inclusive range of 30 and 70 degrees and a side rake angle in an inclusive range of 45 and 135 degrees in a negative direction in relation to a reference surface forward of the recess face and perpendicular to the longitudinal axis.

7. The drill bit of claim 6 where the recess defines an area subject to reverse rotation and a downward and inward orientation of the column cutter limits damage to the column cutter by reverse rotation.

8. The drill bit of claim 6 where shoulder cutters are mounted on the blades facing generally in the direction of bit rotation about the longitudinal axis.

9. The drill bit of claim 8 where the shoulder cutters advance a borehole by shearing rock along a circular path as the bit rotates and forming the column that extends into the recess as the borehole advances.

10. The drill bit of claim 9 where the column cutters contact the column of rock formed as the bit advances to fail the rock of the column.

11. The drill bit of claim 10 where the column cutters contacting the column oppose lateral movement of the bit during operation.

12. A drill bit comprising three column cutters mounted within a recess about a longitudinal axis of a drill bit for advancing a borehole where each said column cutter has a cutter longitudinal axis generally parallel to the longitudinal axis of the drill bit with a positive back rake in an inclusive range of 35 and 55 degrees and a side rake angle in an inclusive range of 70 and 90 degrees in a negative direction in relation to a reference surface perpendicular to the longitudinal axis; and shoulder cutters that advance the borehole with shearing force and create a column that extends into a recess at the advancing end of the bit where the column cutters fail the rock of the column by crushing force.

13. The drill bit of claim 12 where the shoulder cutters are outside the recess.

14. The drill bit of claim 13 where the column cutters contacting the column oppose lateral movement of the bit during operation.

15. The drill bit of claim 12 where only three of said column cutters are at least partially within a recess at the front of the drill bit.

16. The drill bit of claim 12 where the drill bit is a drag bit.

17. The drill bit of claim 12 where the drill bit is a roller cone drill bit.

18. The drill bit of claim 12, wherein the recess defines an area subject to reverse rotation and a downward and inward orientation of the column cutter limits damage to the column cutter by reverse rotation.

19. A drill bit that rotates about a longitudinal axis to advance a borehole comprising:

a bit body with blades, a recess at a leading end in a central cone area of the bit for forming a column of rock as the drill bit is rotated to advance a borehole, and including a longitudinal bit axis;

first cutters mounted in the recess having a cutter longitudinal axis generally parallel to the longitudinal bit axis so as to fail rock by crushing force;

second cutters mounted on the blades facing generally in the direction of bit rotation about the longitudinal axis so as to fail rock by shearing force;

wherein the recess is generally in the shape of a cylinder, dome, cone, or pyramid;

wherein the column cutters are configured to eject fractured portions in a direction from the front of the bit; and wherein each first cutter faces in the direction of advancement and inward with a positive back rake in an inclusive range of 35 and 55 degrees and a negative side rake in an inclusive range of 70 and 90 degrees in relation to a surface forward of the recess face and perpendicular to the longitudinal axis.

20. The drill bit of claim 19 where the second cutters advance the borehole and create a column of rock that extends into the recess at the leading, cone region of the bit which then contacts the first cutters which fail the rock of the column.

21. The drill bit of claim 19 where each first cutter faces in the direction of advancement and inward with a positive back rake in an inclusive range of 40 and 50 degrees and a side rake in an inclusive range of 75 and 85 degrees in a negative direction in relation to a surface forward of the recess face and perpendicular to the longitudinal axis.

22. The drill bit of claim 21, wherein the recess defines an area subject to reverse rotation and a downward and inward orientation of the column cutter limits damage to the column cutter by reverse rotation.

23. The drill bit of claim 19 where the first cutters contacting the column oppose lateral movement of the bit during operation.

24. A drill bit attached to a drill string that rotates about a bit longitudinal axis to advance a borehole comprising:

a bit body with a drill string mounting fixture at a upper, mounting end, a recess in the bit body having a recessed face, a fluid channel for injecting drilling fluid and a conduit from the recessed face to a side of the bit body, wherein the fluid channel and the conduit intersect;

column cutters with a base end mounted in the recessed face, a contact end of each column cutter extending from the recessed face and having a cutter longitudinal axis generally parallel to the bit longitudinal axis to fracture a column of the borehole extending into the recessed surface as the borehole is advanced, wherein the injection of drilling fluid flushes the fractured portions of the column through the conduit and up the borehole; and wherein each column cutter faces downward and inward with a positive back rake in an inclusive range of 35 and 55 degrees and a negative side rake in an inclusive range of 70 and 90 degrees in a negative direction in relation to a reference surface perpendicular to the longitudinal axis forward of the recess face.

25. The drill bit of claim 24 where the recess is defined at least in part by the inner ends of blades that extend from the bit body and which support shoulder cutters that fail rock to advance the borehole.

26. The drill bit of claim 25 where at least three column cutters are mounted at least in part within the recess.

27. The drill bit of claim 24 where the conduit increases in cross sectional area, or diameter, extending from the recessed face to the junk slot or annulus of the bit to limit binding the fractured column cuttings in the conduit.

28. The drill bit of claim 24, wherein the recess defines an area subject to reverse rotation and a downward and inward orientation of the column cutter limits damage to the column cutter by reverse rotation.

* * * * *